US009404273B2

(12) United States Patent
Dawson

(10) Patent No.: US 9,404,273 B2
(45) Date of Patent: Aug. 2, 2016

(54) SCAFFOLD END COVER SYSTEM AND METHOD

(71) Applicant: Richard Dawson, Ukiah, CA (US)

(72) Inventor: Richard Dawson, Ukiah, CA (US)

( * ) Notice: Subject to any disclaimer, the term of this patent is extended or adjusted under 35 U.S.C. 154(b) by 22 days.

(21) Appl. No.: 13/915,631

(22) Filed: Jun. 12, 2013

(65) Prior Publication Data

US 2014/0367196 A1 Dec. 18, 2014

(51) Int. Cl.
*E04G 5/00* (2006.01)

(52) U.S. Cl.
CPC *E04G 5/002* (2013.01); *E04G 5/00* (2013.01); *Y10T 29/49863* (2015.01)

(58) Field of Classification Search
CPC ..... E04G 5/00
See application file for complete search history.

(56) References Cited

U.S. PATENT DOCUMENTS

| | | | | |
|---|---|---|---|---|
| 6,419,046 | B1 * | 7/2002 | Cubbison | 182/129 |
| 7,303,089 | B2 * | 12/2007 | Keller | 220/295 |
| 2006/0180092 | A1 * | 8/2006 | Reiter | 119/712 |

FOREIGN PATENT DOCUMENTS

| | | | |
|---|---|---|---|
| GB | 2435068 A | * | 8/2007 |
| GB | 2446477 A | * | 8/2008 |

* cited by examiner

*Primary Examiner* — Alvin Chin-Shue
(74) *Attorney, Agent, or Firm* — NWAMU, PC

(57) ABSTRACT

A system and method for covering a scaffold end with a scaffold cover. The system includes a cap or scaffold cover having a closed end for providing a force-absorbing surface, and an open end for receiving a scaffold end. The open end includes a lip and a lip notch working cooperatively with a spring and rest notch to securely lock the scaffold cover in place.

6 Claims, 7 Drawing Sheets

SCAFFOLD END COVER SYSTEM AND METHOD

BACKGROUND OF THE INVENTION

The present invention relates generally to protective scaffold covers and more specifically to a system and method for covering scaffold ends.

Typically, a scaffold is a temporary structure used to support people and material in the construction or repair of buildings and other large structures. The scaffold rests adjacent to the building to provide access to the building. In this manner, construction material may be efficiently traversed to desired areas of the building or structure.

Because scaffolds are formed from hollow tubes with open ends, they often become resting places for debris. The debris can include rivets, screwdrivers, welding rods, dust and liquid. The debris causes undesirable results, such as weighing down the scaffold and falling out on a pedestrian or worker.

As a result, some scaffold ends have small extensions with protrusions to seal these open scaffold ends. The protrusions are relatively small and may not be too visible. Consequently, the protrusions may form dangerous extensions capable of poking an unwary pedestrian or worker.

One common solution to avoid inadvertently walking or bumping into scaffold ends is to provide a force-cushioning buffer on the scaffold to help dissipate the force of impact from these types of collisions. However, the buffer can easily dislodge from the scaffold end if not secured properly due to weather conditions, construction accidents, and collisions.

The cost of buffering all of the scaffold ends on a large scaffold structure is also problematic for larger buildings that require extensive scaffold structures. These techniques have had limited, if any, success.

There is a need to address one or more of the foregoing disadvantages of conventional systems and methods, and the present invention meets this need.

BRIEF SUMMARY OF THE INVENTION

Various aspects of a system and method for covering a scaffold end can be found in exemplary embodiments of the present invention.

In one embodiment, a cap cover system attaches to a scaffold end to provide protection from inadvertent collisions between the scaffold end and a person or object. The cap cover system helps protect pedestrians, workers, and machines against injury and damage by covering the scaffold end, absorbing impact forces, and incorporating features to enhance visibility of the scaffold end. The cap cover system further provides an aesthetic surface for covering an unsightly scaffold end.

The cap cover system includes a cap disposed to cover a scaffold end. In this manner, a scaffold end with a sharp or open terminal point may be covered to minimize injury and provide an aesthetic surface. The cap includes an open end and a closed end sized and dimensioned to cover the scaffold end.

The open end includes a peripheral lip and notch, the peripheral lip extending inwardly, and provides a supporting ledge for the scaffold end. The cap comprises an internal spring that attaches to an interior surface of the closed end, and extends outwardly towards the open end. The spring serves to receive the scaffold end and exert a compressive force used to secure the cap onto the scaffold end.

The scaffold end passes through the one end of the cap and presses against the spring to create a compressive force. The compressive force generates opposing tension forces between the scaffold protrusion and the peripheral lip and upon further rotation of the cap in a first direction, the scaffold protrusion reaches the rest notch where it is locked to secure the cap onto the scaffold end.

Conversely, a rotation of the cap in a second direction, at a predetermined arc length, allows the cap to slip off the scaffold end and releases the scaffold protrusion from the rest notch, past the peripheral lip through the lip notch, as the scaffold protrusion is released from the compressive force of the spring to unsecure the cap cover.

A further understanding of the nature and advantages of the present invention herein may be realized by reference to the remaining portions of the specifications and the attached drawings. Further features and advantages of the present invention as well as the structure and operation of various embodiments of the present invention are described in detail below with respect to the accompanying drawings. In the drawings, the same reference numbers indicate identical or functionally similar elements.

DETAILED DESCRIPTION OF THE INVENTION

Reference will now be made in detail to the embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth to provide a thorough understanding of the present invention. However, it will be obvious to one of ordinary skill in the art that the present invention may be practiced without these specific details. In other instances, well-known methods, procedures, components, and circuits have not been described in detail so as to not unnecessarily obscure aspects of the present invention.

Figure 1A:
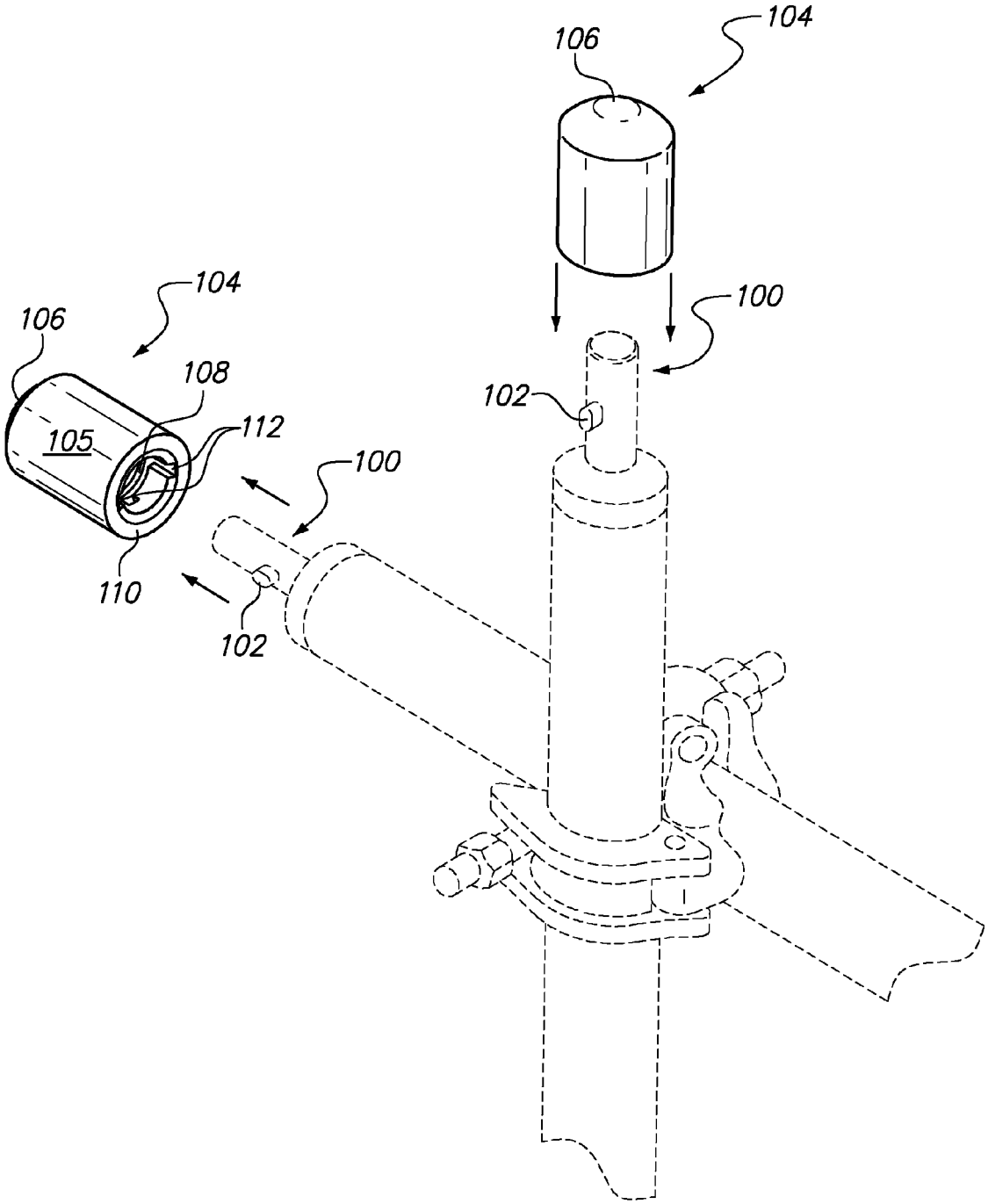
FIG. 1A illustrates a detailed perspective view of a scaffold end and a cap according to an exemplary embodiment of the present invention.

FIG. 1A illustrates a scaffold cover 104 system according to an exemplary embodiment of the present invention.

In FIG. 1A, the scaffold cover 104 can cover an exposed scaffold end 100 as shown. By covering the scaffold end 100 having sharp or open terminal points, injury from collisions can be minimized while providing an aesthetically pleasing surface.

Those skilled in the art will recognize that the scaffold end 100 may extend onto walkways or work areas where pedestrians and workers may have inadvertent collisions with the scaffold end 100. A visible force-absorbing scaffold cover 104 can prevent or minimize injury and damages.

The scaffold cover 104 is substantially silo-shaped and is sized and dimensioned to cover the scaffold end 100. Thus, the diameter of the scaffold cover 104 depends upon the diameter of the scaffold end 100. The scaffold cover 104 may be fabricated from a material efficacious for absorbing the force of an impact including, without limitation, high density polymers, fiberglass, wood, and polyvinyl chloride, etc.

The scaffold cover 104 includes a closed end 106 that is fabricated to provide a force-absorbing surface. The closed end 106 includes a smooth, rounded surface, configured to minimize injury with colliding objects, such as pedestrians, workers, and machines. However, in other embodiments, the closed end 106 may include a variety of shapes, including, without limitation, a square, an oval, and a T-shape.

The scaffold cover 104 also includes an open end 108 further illustrated with reference to FIG. 2. In FIG. 1A, the open end 108 is oppositely disposed from the closed end 106, the open end 108 and the closed end 106 being coupled by a cylindrically-shaped body 105. The open end 108 is configured to receive the scaffold end 100.

The open end 108 is disposed within a peripheral lip 110 that extends around the inside periphery of the cylindrical shaped body 105, said peripheral lip 110 also extending in thickness inward toward the closed end 106. The thickness of this peripheral lip 110 provides a supporting ledge for scaffold protrusion 102 to secure the scaffold cap 104 in place when said cap is used to cover the scaffold end 100.

In FIG. 1A, the peripheral lip 110 also includes lip notches 112 that allow at least partial passage of the scaffold end 100 into the open end 108, all of which features are further described with reference to FIGS. 2-6.

Figure 1B:
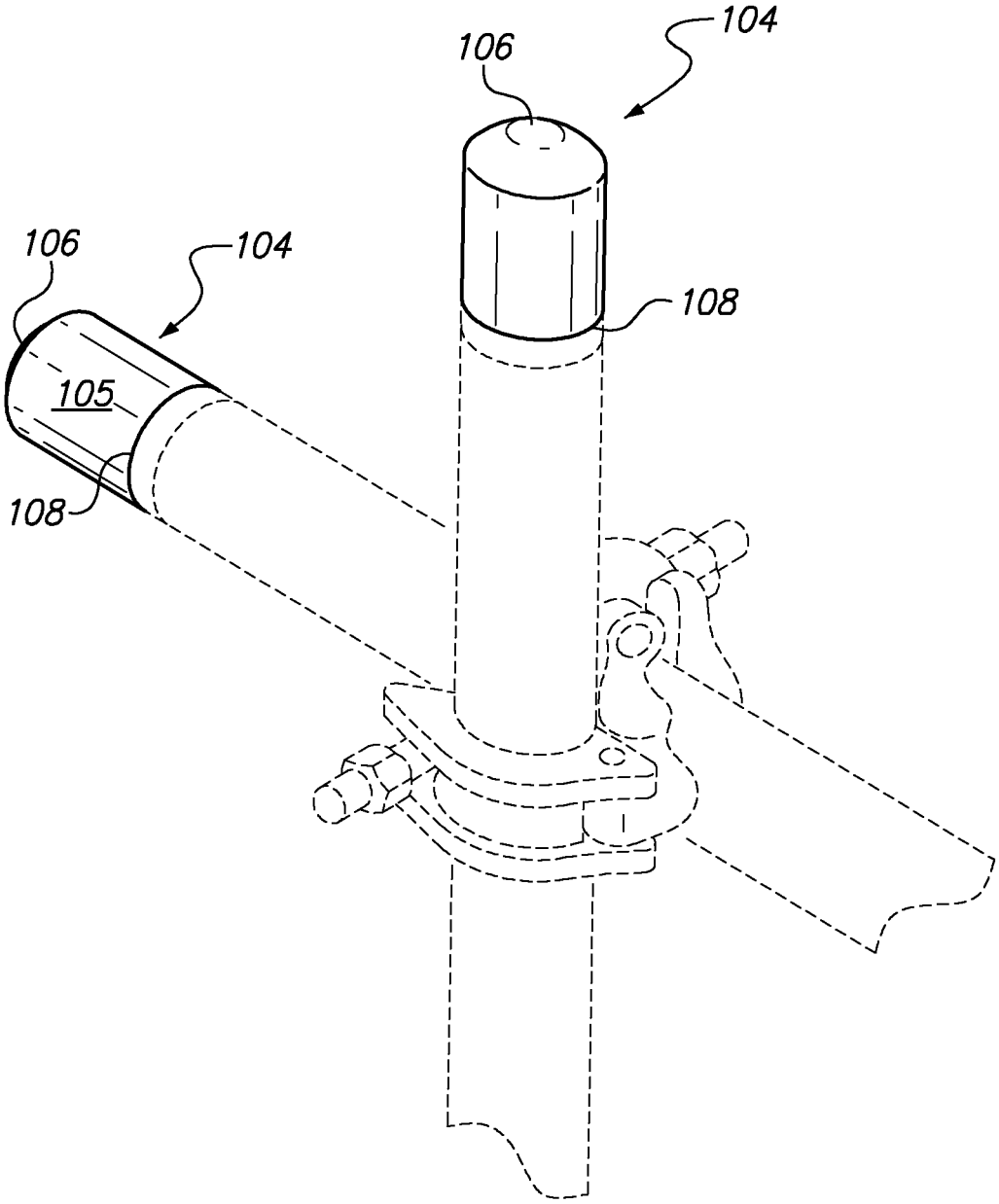
FIG. 1B illustrates a detailed perspective view of a cap over the scaffold end of FIG. 1A according to an exemplary embodiment of the present invention.

In use, as can be seen for each scaffold end 100, the scaffold cover 104 is placed over the scaffold end 100 by aligning the lip notch 112 with the scaffold protrusion 102 and inserting the scaffold cover 104 along the direction indicated by the arrows until the scaffold end 100 is covered as further illustrated in FIG. 1B. In one embodiment, the peripheral lip 110 comprises two diametrically positioned lip notches 112 that pass over two scaffold protrusions 102.

In one alternative embodiment, the scaffold cover 104 may include ridges (not shown) along a longitudinal axis that compress upon engagement with a force of impact from a colliding object. In this manner, collisions with colliding objects are dampened, thereby protecting both the colliding object and a scaffold structure.

FIG. 1B illustrates the scaffold cover 104 covering the scaffold end 100 (FIG. 1A) according to an exemplary embodiment of the present invention.

In FIG. 1B, as shown, the scaffold end 100 is no longer visible as it is completely covered by the scaffold cover 104. Thus, injury to pedestrians, workers and the like is avoided. Although not shown, it is contemplated that the scaffold cover 104 can also provide a partial covering to scaffold end 100.

Figure 2:
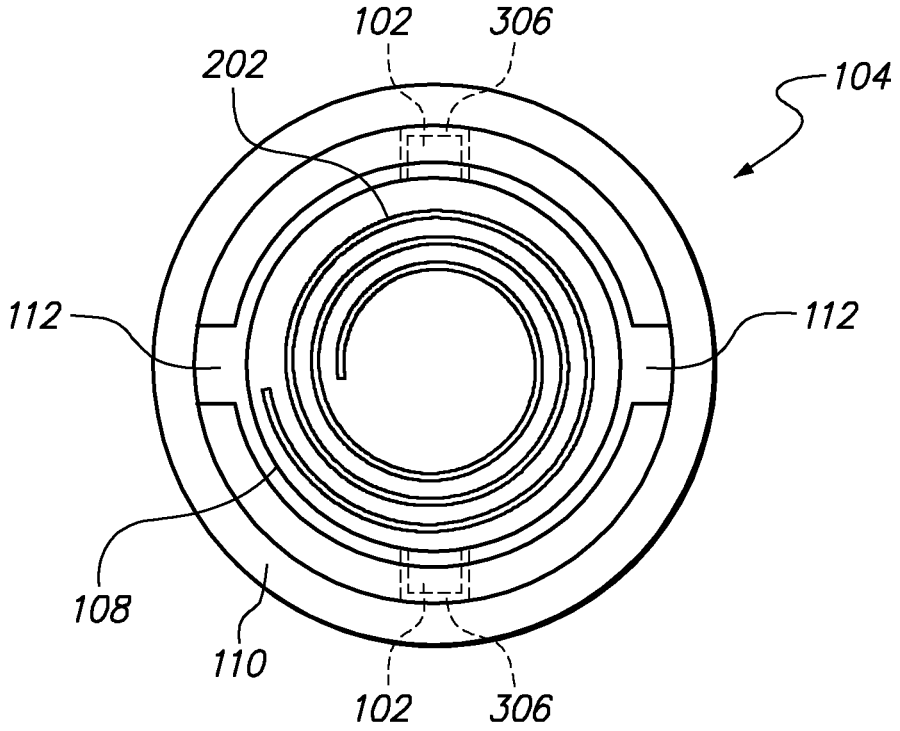
FIG. 2 illustrates a bottom view of a spring according to an exemplary embodiment of the present invention.

FIG. 2 illustrates a bottom plan view of the scaffold cover 104 that shows the open end 108 of FIG. 1.

In FIG. 2, the open end 108 is sized and dimensioned to receive the end of a tube or pipe, often used for scaffold structures such as the scaffold end 100 of FIG. 1A. In one embodiment, an exemplary diameter of the open end 108 is 1.5".

As noted, the open end 108 is subsumed within the peripheral lip 110 (FIG. 1) that supports at least one scaffold protrusion 102 (FIG. 1B) extending from the scaffold end 100, as further described with referenced to FIGS. 3A and 3B.

As previously noted, the peripheral lip 110 extends inwardly (towards the internal spring 202), preferably about $\frac{1}{8}^{th}$ of an inch and is of sufficient rigidity to support the weight of the scaffold protrusion 102. In one embodiment, the radius "x" of the peripheral lip 110 extending from the cylindrically-shaped body 105 to the open end 108 is preferably about $\frac{1}{4}^{th}$ of an inch. Although not necessary, the peripheral lip 110 is fabricated from the same material as the scaffold cover 104.

The peripheral lip 110 includes at least two lip notches 112 that are substantially disposed opposite each other for enabling at least partial passage of the scaffold protrusion 102. In this manner, after the scaffold protrusion 102 passes through the lip notch 112, rotation of the scaffold cover 104 in a clockwise direction urges the scaffold protrusion 102 onto engagement with the interior of the peripheral lip 110 until each scaffold protrusion 102 reaches a corresponding rest notch 306 (FIG. 3), where the scaffold protrusion 102 is engaged and locked into.

The scaffold cover 104 comprises the internal spring 202 that attaches to an interior surface 304 (FIG. 3) of the closed end 106, and extends outwardly towards the open end 108. In one embodiment, the internal spring 202 is attached via grooved threads on the interior surface 304 of closed end 106. The internal spring 202 may include, without limitation, a helix spring, a compression spring, a torsion spring, or a cantilever spring.

In some embodiments, the scaffold cover 104 covers the scaffold end 100 such that the scaffold end 100 presses against the internal spring 202 to create a compressive force. The compressive force generates opposing tension forces that press the scaffold protrusion 102 against the peripheral lip 110 and reach rest notch 306 to secure the scaffold cover 104 onto the scaffold end 100.

Specifically, the scaffold protrusion 102 passes through the lip notch 112 and engages the internal spring 202, which causes an opposing tension force between the internal spring 202 and the scaffold end 100. Rotation of the scaffold cover 104 in a clockwise direction presses the peripheral lip 110 against the scaffold protrusion 102 and as rotation continues, rest notch 106 is reached. At this point, the opposing tension force then locks scaffold protrusion 102 into rest notch 106 to form a secure attachment and retain the scaffold cover 104 over the scaffold end 100.

Conversely, rotation of the scaffold cover 104 in a counter clockwise direction, at a predetermined arc length, allows the scaffold cover 104 to slip off the scaffold end 100 by releasing scaffold protrusion 102 from the rest notch 106 to the peripheral lip 110, until the scaffold protrusion 102 and the lip notch 112 are aligned, after which the opposing tension force on the spring 202 releases the cover 104.

Figure 3:
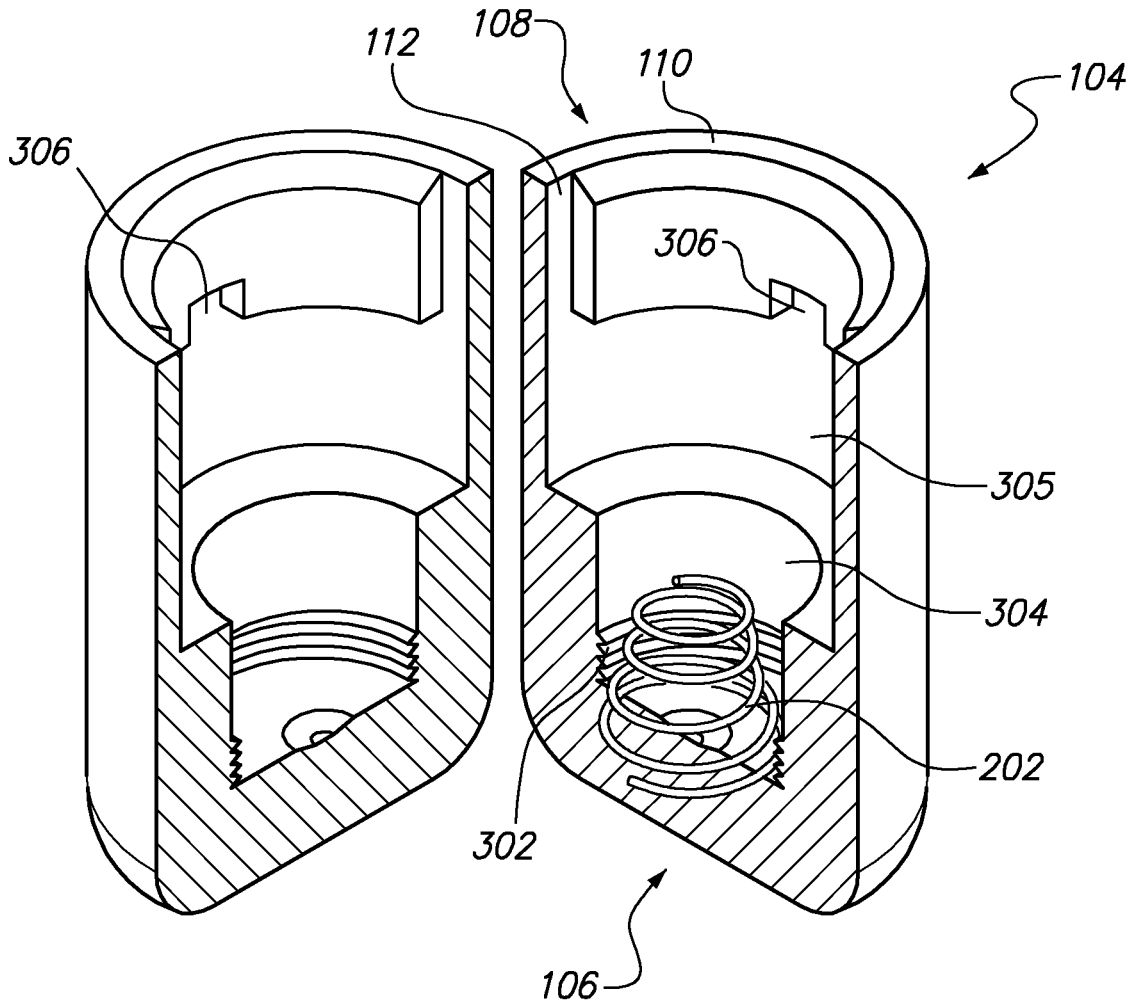
FIG. 3 illustrates a cross sectional view of a cap according to an exemplary embodiment of the present invention.

FIG. 3 illustrates a cross-sectional view of scaffold cover 104 according to an exemplary embodiment of the present invention.

In FIG. 3, specifically, internal components are shown when scaffold cover 104 is split along its cross-section. As can be seen, peripheral lip 110 includes the lip notch 112 as well as scaffold protrusion groove 305, wherein the scaffold protrusion 102 rotates before coming to rest within the rest notch 306 as further described with reference to FIG. 5. A spring groove 302 is positioned adjacent to the internal spring 202 and forms a peripheral groove on the interior surface 304 of the closed end 106 is also shown.

Figure 4:
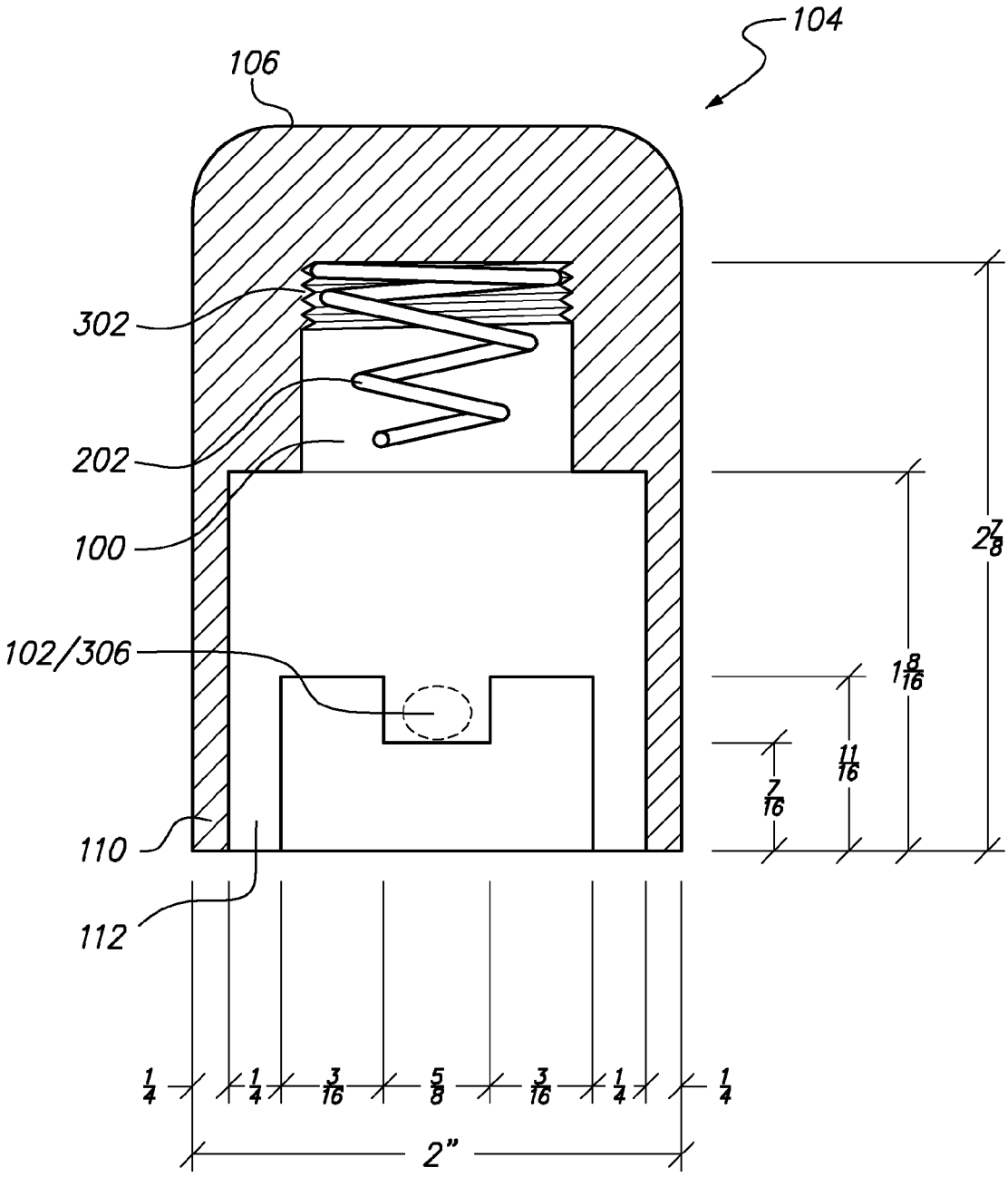
FIG. 4 illustrates a cross sectional view of a cap engaged with a scaffold end according to an exemplary embodiment of the present invention.

FIG. 4 illustrates a cross-sectional view of scaffold cover 104 covering scaffold end 100 according to an exemplary embodiment of the present invention.

In FIG. 4, scaffold cover 104 covers scaffold end 100 such that internal spring 202 is compressed as shown. The scaffold protrusion 102 is also at rest within the rest notch 306 as shown. Exemplary dimensions in inches for various lengths of the scaffold cover 104 are shown. As an example, the dimension of the rest notch 306 is $^{10}/_{16}{}^{th}$ of an inch. One skilled in the art will understand that the dimensions herein shown are exemplary and can be modified as necessary depending on the dimensions of the scaffold end 100.

Figure 5:
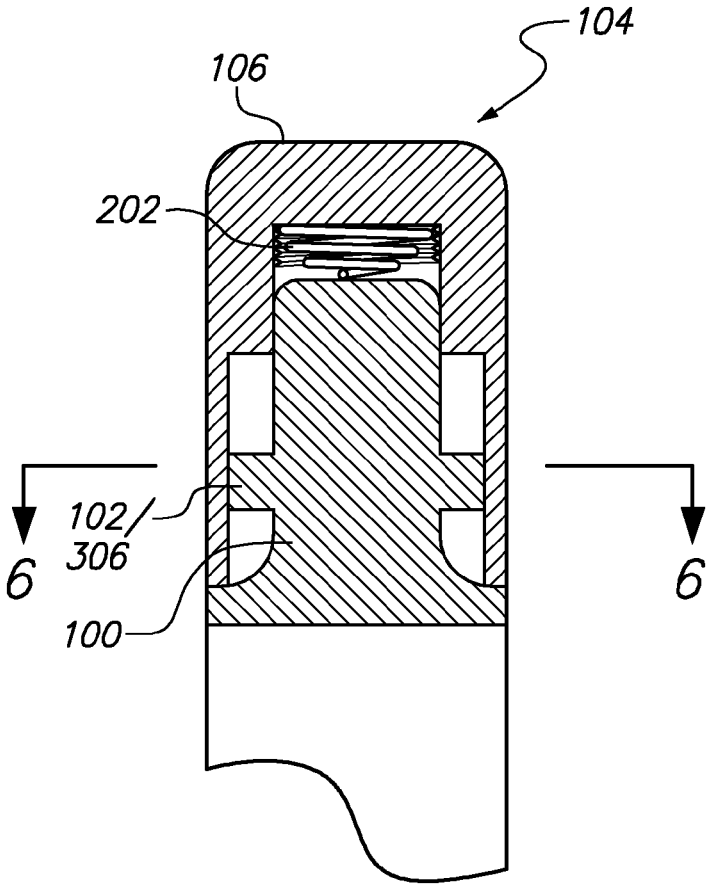
FIG. 5 illustrates a cross sectional view of a cap engaging a scaffold end according to an exemplary embodiment of the present invention.

FIG. 5 depicts the scaffold cover 104 over the scaffold end 100 so that the internal spring 202 creates a compressive force.

This compressive force generates opposing tension forces between the peripheral lip 110 (FIG. 1A and FIG. 2) and the scaffold protrusion 102 to press the scaffold cover 104 onto the scaffold end 100.

Those skilled in the art will recognize that the compressive force created by the internal spring 202 is proportional to the displacement of the compression of the internal spring 202. In this manner, the scaffold protrusion 102 is sufficiently forced against the peripheral lip 110 to secure the scaffold cover 104 against the scaffold end 100.

A spring groove 302 (FIG. 3) positions adjacent to the internal spring 202, forming a peripheral groove on the interior surface 304 (FIG. 3) of the closed end 106. The spring groove 302 comprises a threaded section of the interior surface 304, sized and dimensioned to receive and hold a portion of the internal spring 202.

Upon rotation in the first direction, the spring groove 302 receives a portion of the internal spring 202 to attach the internal spring 202 to the interior surface 304. The internal spring 202 can be detached by rotating the spring in a counter clockwise direction.

In operation, the scaffold end 100, often having sharp or protruding members, is identified. The system for covering the scaffold end 100 is operable to provide a cover for various sizes and shapes of scaffold ends 100. In all cases, sharp or dangerous protrusions from the scaffold end 100 are covered.

The scaffold cover 104 initially orients so that the open end 108 faces the scaffold end 100. The scaffold end 100 may be pointed in any direction for the scaffold cover 104 to provide a cover, for example, a downwardly pointing scaffold end 100 being in proximity to a walkway.

The lip notch 112 aligns with the scaffold protrusion 102 in preparation for coupling. The position of the lip notch 112 and the scaffold protrusion 102 are determinative of the final positioning of the scaffold cover 104 in relation to the scaffold end 100.

The scaffold cover 104 presses towards the scaffold end 100, with the lip notches 112 allowing the scaffold protrusions 102 to pass through until the interior surface 304 presses against the internal spring 202. The scaffold cover 104 then rotates in a clockwise direction for about a quarter of the angular length of the scaffold cover 104.

Those skilled in the art, in light of the present teachings, will recognize that the direction of the spirals on the internal spring 202 and the diameter of the internal spring 202 are determinative of the direction and amount of the rotation.

Upon rotation, the scaffold protrusion 102 engages the peripheral lip 110. The scaffold protrusion 102 is then positioned between the compressive force of the internal spring 202 and the rigid bather provided by the interior of the peripheral lip 110 while the scaffold protrusion 102 is rotatable because of the scaffold protrusion groove 305 (FIG. 3). The scaffold protrusion groove 305 is located radially within the scaffold cover 104 housing extending between the oppositely disposed lip notches 112.

The opposing tension force between the internal spring 202 and the scaffold end 100 presses the scaffold protrusion 102 against the peripheral lip 110, and as the scaffold cover is rotated and reaches the rest notch 306, the opposing tension force exerts a force that locks each scaffold protrusion 102 into place within the rest notch 306 to form a secure attachment and retain the scaffold cover 104 over the scaffold end 100. The scaffold cover 104 securely positions on the scaffold end 100, whereby an external force or gravity may not cause the scaffold cover 104 to detach from the scaffold end 100.

The scaffold cover 104 is released by applying downward pressure on the scaffold cover 104 to ease the scaffold protrusion 102 out of the rest notch area 306 into the scaffold protrusion groove 305 (and the peripheral lip 110) and then by rotating the scaffold cover 104 in a counter clockwise direction for a quarter of the angular length of the scaffold cover 104 until the lip notch 112 is reached. The scaffold protrusion 102 is released via the lip notch 112 by the compressive force of the internal spring 202.

In this manner, the peripheral lip 110, the lip notch 112, the scaffold protrusion groove 305 and the internal spring 202 work cooperatively to secure and release said scaffold cover 104 to and from the scaffold end 100 in accordance with principles and precepts of the present invention. In one alternative embodiment, a latch or lock may help retain the internal spring 202 against the spring groove 302, as referenced in FIG. 6.

Figure 6:
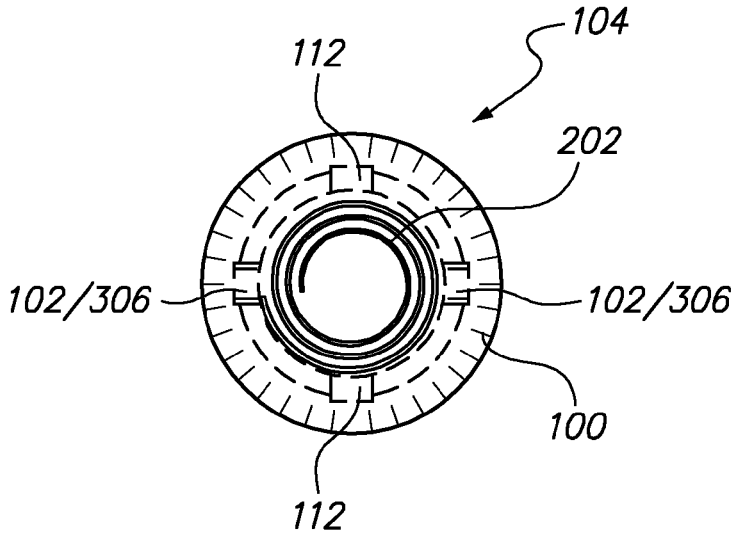
FIG. 6 illustrates a top plan view of a cap according to an exemplary embodiment of the present invention.

FIG. 6 illustrates a top plan view of scaffold cover 104 according to an exemplary embodiment of the present invention.

In FIG. 6, specifically, a view looking through open end 108 of FIG. 1A is shown. The two scaffold protrusions 112 are a quarter turn away from the two lip notches 112 after the scaffold cover 104 is in place. The internal spring 202 is also shown.

Figure 7:
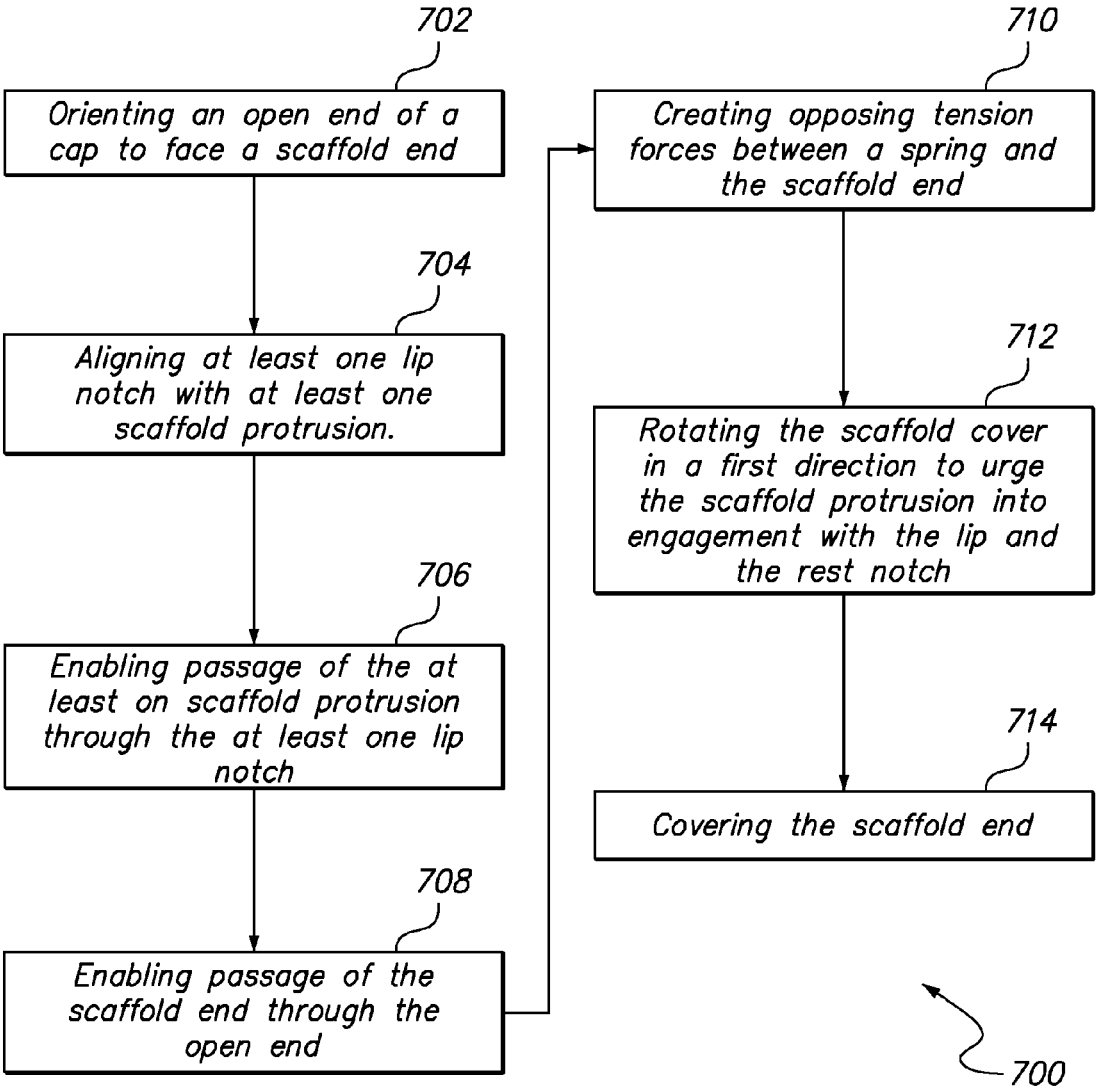
FIG. 7 illustrates a flowchart diagram for a method for covering a scaffold end according to an exemplary embodiment of the present invention.

FIG. 7 illustrates a flowchart diagram for a method 700 for covering a scaffold end 100, according to an embodiment of the present invention.

In FIG. 7, in summary, the method for covering a scaffold end 100 is efficacious for at least partially covering a scaffold end 100. The method comprises an initial step of orienting an open end 108 of the scaffold cover 104 to face the scaffold end 100. The scaffold cover 104 positions to cover the terminal sections and aberrations and protruding members on the scaffold end 100. The process then may proceed to a step, which involves aligning the lip notches 112 with the scaffold protrusions 102. In some embodiments a pair of protruding abutments or scaffold protrusions 102 position on each side of the scaffold ends 100. A next step includes enabling at least partial passage of the scaffold protrusion 102 through the lip notch 112. A further step includes enabling at least partial passage of the scaffold end 100 through the open end 108, which fits over the scaffold end 100. A next step includes creating opposing tension forces between the internal spring 202 and the scaffold end 100. The internal spring 202 is configured to store potential energy in the form of these opposing tension forces.

A latch or hook may be utilized to help retain the internal spring 202 in the compressed position. In some embodiments, a step includes rotating the scaffold cover 104 in a clockwise direction to urge the scaffold protrusion 102 into engagement with the peripheral lip 110 and the rest notch 306. The opposing tension forces serve to press the peripheral lip 110 against the scaffold protrusion 102 and subsequently into the rest notch 306, where the scaffold protrusion 102 is locked. Finally, a step includes covering the scaffold end 100. This may serve to restrict physical and visual contact with the scaffold end 100.

In FIG. 7, more specifically, the method 700 comprises an initial step 702 of orienting an open end 108 of the scaffold cover 104 to face the scaffold end 100. A scaffold structure may comprise a structure of pipes and tubes having sharp ends, burrs, and shards. The scaffold cover 104 positions to cover these aberrations.

The method then may proceed to a step 704, which involves aligning the lip notch 112 with the scaffold protrusion 102. In one embodiment, two scaffold protrusions 102 pass through two lip notches 112.

A next step 706 includes enabling at least partial passage of the scaffold protrusion 102 through the lip notch 112. The lip notch 112 is sized and dimensioned to allow passage of the scaffold protrusion 102. The shapes and dimensions of the lip notch 112 and the scaffold protrusion 102 may include, without limitation, rectangle, square, oval, and pyramid.

The method then may proceed to a step 708 that includes enabling at least partial passage of the scaffold end 100 through the open end 108. The open end 108 is configured to fit over the scaffold protrusion 102.

Step 710, creates opposing tension forces with the internal spring 202 between the peripheral lip 110 and the scaffold protrusion 102. The internal spring 202 is configured to store potential energy when compressed. This compressive force generates opposing tension forces between the peripheral lip 110 and rest notch 306 and the scaffold protrusion 102.

A step 712 includes rotating the scaffold cover 104 in the first direction to urge the scaffold protrusion 102 into engagement with the peripheral lip 110 until the scaffold protrusion 102 arrives at the rest notch 306 where the scaffold protrusion 102 is locked to secure the scaffold cover 104 onto the scaffold end 100. The first direction may include a clockwise direction at about a quarter of a cap arc length.

Conversely, rotating the scaffold cover 104 in a second direction allows the scaffold protrusion 102 to unlock from rest notch 306 and to pass through the lip notch 112, and thereby disengage the scaffold end 100 from the scaffold cover 104. The second direction may include a counter clockwise direction at a about a quarter of a cap arc length.

Finally, a step 714 includes covering the scaffold end 100 with the scaffold cover 104. This may serve to restrict physical and visual contact with the scaffold end 100.

In some embodiments, the scaffold cover 104 may include preventive features designed to help minimize initial contact with the scaffold end 100. For example, without limitation, a highly visible paint, such as a fluorescent color, may coat the scaffold cover 104 to create a visible warning and aesthetic design.

Thus, the above description should not be taken as limiting the scope of the invention, which is defined by the appended claims along with their full scope of equivalents.

I claim:

1. A system comprising:

a scaffold end with at least two oppositely disposed protrusions;

a cap having a closed end and a wall extending from the closed end to an open end, the closed end, wall and open end defining an upper interior cavity that is tubular and a lower interior cavity that is tubular, wherein the upper interior cavity is bounded by an interior surface of the closed end, wherein the lower interior cavity is bounded by the open end, wherein the upper interior cavity has a smaller dimension relative to a larger dimension of the lower interior cavity, wherein the smaller dimension of the upper interior cavity engages the scaffold end to secure the scaffold end therein, wherein the larger dimension of the lower interior cavity engages the two protrusions that are disposed opposite each other to secure the protrusions therein, wherein said cap comprising the closed end having a force-absorbing surface, wherein said open end is configured to receive at least partial passage of said scaffold end, said open end having a lip configured to support the scaffold protrusions, said lip having at least one lip notch for enabling at least partial passage of at least one of said scaffold protrusion, wherein rotation of said cap in a first direction urges said at least one scaffold protrusion into engagement with said lip, said cap further comprising a spring, said spring being disposed to attach to said closed end, said spring further being disposed to remain within said upper interior cavity when at rest and when not extended, said spring being configured to engage said scaffold end, said spring being operable to create a compressive force against said scaffold end, wherein said compressive force creates opposing tension forces between said spring and said scaffold end, said opposing tension forces being operable to press said at least one scaffold protrusion against said lip, said closed end comprising a spring groove for engaging said spring, said spring groove being configured to secure said spring in a compressed position, wherein rotation of said cap in said first direction urges said spring into engagement with said spring groove.

2. The system of claim 1, wherein said force absorbing surface comprises a high density polymer material.

3. The system of claim 1, wherein said spring comprises a helical spring.

4. The system of claim 1, wherein said spring rotatably engages said scaffold end.

5. The system of claim 1, wherein said spring groove comprises a plurality of grooves operable to secure a portion of said spring to said spring groove.

6. The system of claim 1, wherein said cap comprises a length of 3 inches, a width of 2 inches, and a thickness of 8/16 of an inch.

* * * * *